United States Patent [19]

Poldervaart et al.

[11] Patent Number: 5,041,038

[45] Date of Patent: Aug. 20, 1991

[54] OFFSHORE LOADING SYSTEM

[75] Inventors: Leendert Poldervaart, La Turbie; David J. Taylor-Jones, St. Blaise, both of France

[73] Assignee: Single Buoy Moorings Inc., Marly, Switzerland

[21] Appl. No.: 438,965

[22] Filed: Nov. 20, 1989

[51] Int. Cl.[5] ..... B63H 21/12

[52] U.S. Cl. ..... 440/5; 114/230; 440/3

[58] Field of Search ..... 441/3-5; 114/230, 294; 141/387; 166/352-355

[56] References Cited

U.S. PATENT DOCUMENTS

| | | | |
|---|---|---|---|
| 4,281,611 | 8/1981 | Vilain | 114/230 |
| 4,490,121 | 12/1984 | Coppens et al. | 441/5 |
| 4,509,448 | 4/1985 | Pease et al. | 114/230 |
| 4,701,143 | 10/1987 | Key et al. | 441/5 |
| 4,741,716 | 5/1988 | Hasabe et al. | 441/3 |
| 4,765,378 | 8/1988 | Engelskirchen | 441/4 |
| 4,892,495 | 1/1990 | Svensen | 114/230 X |

FOREIGN PATENT DOCUMENTS 1219942 1/1971 United Kingdom .

*Primary Examiner*—Ed Swinehart
*Attorney, Agent, or Firm*—Young & Thompson

[57] ABSTRACT

Offshore loading system comprising a dynamically positioned vessel and at least two flexible elements, such as hoses extending in different directions from two spaced apart locations according to a preferably double catenary configuration towards a disconnectable coupling provided on an outboard extending arm of the vessel, the arm being swingable inboard and outboard while in the disconnected mode of the coupling. The central position of the coupling is obtained by the catenary configuration of the flexible elements, preferably by giving these elements the form of a double catenary line, obtained by means of a buoyancy device attached to each element and anchored to the sea bottom by a cable or the like.

5 Claims, 4 Drawing Sheets

OFFSHORE LOADING SYSTEM

SHORT DESCRIPTION OF THE STATE OF THE ART

The present invention relates to an offshore loading system comprising a floating device with an outward extending arm carrying a swivel and the fluid connections from the swivel towards the floating device, a turntable rotatably supported by the outer end of the said arm, a quick action coupling situated at the turntable, the disconnectable reconnectable part thereof having buoyancy, a hose extending downwards from the disconnectable part of the coupling towards a location at or near the water bottom, according to a catenary configuration.

The invention more particularly, but not exclusively, relates to a loading system in which the hose extends towards the said location at or near the water bottom according to a double catenary configuration obtained by a buoyancy device attached to the hose at a point between the coupling and the said location.

An offshore loading system of this type is known e.g. from U.S. Pat. No. Reissue 32,578 which is a Reissue of U.S. Pat. No. 4,490,121.

From this patent an offshore loading system is known in which the anchoring of the vessel and the connection of the hose or hoses with a location at the water bottom are combined. The vessel has a rigid arm at the bow carrying the swivel and associated pipe lines and carrying below the arm, through the intermediance of a universal joint, the two parts of a quick action coupling of which the upper part in the disconnected mode remains connected to the vessel and of which the lower part in the disconnected mode moves at or below water level. The hose or hoses are connected to the lower end of said disconnectable part and held in a double catenary fashion by means of a buoyancy device. Moreover said disconnectable part has anchor chains connected thereto which extend in different directions, thereby mooring the vessel when in connected mode and also mooring the disconnectable part after disconnection has taken place. Said disconnectable part has a pick-up line and float. In the disconnected mode said coupling has to carry the weight of the anchor chains that are designed for anchoring a tanker and accordingly have weights which are out of proportion when compared to the dimensions of the disconnectable part of the coupling, whose dimensions, although not small, could be considerably reduced if it were not necessary to give that part sufficient buoyancy to carry the chains.

BACKGROUND OF THE INVENTION

In arctic areas it sometimes is necessary to have an offshore loading system which allows for immediate removal of the floating device, such as a tanker. Therefore the system should not be extremely heavy, at least with respect to the disconnectable part, which in disconnected mode has to move below water level. Moreover, a small weight is easier to lift when the mooring system has to be reconnected.

A reduction in weight is obtained by removing the anchor chains but this would not be total solution because the hoses could be subjected to large movements, sharp bends and high tension forces.

The purpose of the invention is to obtain an offshore loading system which has the means to avoid these undesirable effects.

DESCRIPTION OF THE INVENTION

According to the invention the above aim is achieved in principle in that at least two flexible elements, comprising at least one hose extend away from each other from locations on opposite sides of a center line through the coupling when the floating device is in its non-displaced position, said two elements being connected to the water bottom, that the floating device is of the dynamically positioned type, and the turntable at the end of the arm is provided with a drive system.

A dynamically positioned vessel or the like floating device allows, if desired, a reasonably precise means of staying on location even with wave heights of 5 to 8 meters, but also allows considerable displacements if for example floating ice of a possibly dangerous size is to be avoided.

If only one hose, or one set of hoses which extend side by side is used, the other flexible element or elements can be a chain or chains extending in directions which are oriented away from the direction of the hose or set of hoses.

By arranging the hose and the chains in accordance with balanced catenary configurations the coupling is centered to a known position when in the disconnected mode.

Due to the fact that the floating device is of the dynamically positioned type, the chains need not and do not have a function in anchoring said device.

According to the invention an embodiment is preferred in which at least two of the flexible elements, if not all, are hoses extending away from each other with each hose extending according to a double catenary configuration which is obtained by means of a buoyancy device attached to the water bottom by a cable or the like connected to an anchor.

Consequently anchor chains are avoided and the disconnectable part of the coupling is no longer required to be designed to be capable of carrying the weight of said chains in the disconnected mode.

To carry a hose by means of a float between a coupled point and a location at the water bottom is well known in itself. By locating two hoses or more in a manner opposite each other, so that a kind of symmetry is obtained with respect to the central position of the coupling and by providing said hoses with floats, which floats keep each hose in its double catenary fashion, with an anchor cable which extends downwardly to an anchor at the water bottom, a symmetrical centralizing situation is obtained for the coupling in its disconnected mode so that, if disconnection occurs, the coupling will always move towards a submerged known position between the floats. By said means, however, it is also possible during the operational connected mode to provide for a large degree of flexibility, allowing the tanker to move reasonably far away from its central position if circumstances require this.

This holds true as well in the case that there is only one hose and one or more chains extending in different directions, because said hose and chains or the like even when arranged in a single catenary configuration will centralize a disconnected coupling and also allow a large area within which the floating device may keep its position without overstressing the flexible elements. It should also be noted that in both connected and disconnected modes if the hoses are in a central known position, which is predetermined and calculated, no undesirable motions or forces can act on the hoses to cause possible damage or rupture and consequently an oil spillage.

After disconnection the central position of the submerged coupling part facilitates the reconnection, in particular if no pick-up line with float is used or said pick-up line is destroyed, e.g. by ice.

The circular bearing of the coupling has a frictional resistance which is larger than the torsional resistance of the hoses. Because of the absence of a rigid connection between the hoses and the sea bottom no anchored restraint against torsion can be exerted so that during weathervaning operations the hose or hoses could be turned out of position and subjected to torsion. Therefore the turntable of the outwardly extending arm possesses a drive system of sufficient power to block the flexible elements in an anchored position when the floating device weathervanes.

The drive system of the turntable can be activated manually but it is preferred to provide for a control system which is logically integrated into the tanker dynamic control positioning system.

A rigid arm at the bow of the vessel which forms the floating device is well known.

Said arm extends above water level, but could also be an arm below water level.

According to a further aspect of the invention the arm is rotatably mounted in a pedestal and means are provided to swing the arm inboard and outboard respectively as well as means to lock the arm in either one of said positions.

Said arm can be mounted at the bow or the stern of the vessel, but preferably is substantially mounted upon the deck in the middle of one side of the floating device. This is a location where the movements of the vessel in particular the pitch motions are small so that the downwardly extending hoses are subjected to less movement and accordingly lower forces when the vessel rides on the waves.

The possibility to swing the arm inboard is of importance for ease of maintenance, in case the vessel has to sail away and during harbour activities. It is known to provide the disconnectable part of the coupling with a pick-up line.

Because the invention has resulted in the bouyant capacity of the disconnectable part of the coupling becoming considerably smaller a problem arises if the hoses are filled with a heavy or a light liquid. If the heavy liquid, such as water, prevails then the coupling will move further downward than in the case when oil prevails.

According to the invention the pick-up line now can have a series of additional floats which come into function as soon as the disconnected coupling tends to sink too deep.

According to the invention the disconnectable buoyant part of the coupling may carry a weight, by means of a cable which preferably positions the weight far below water level allowing the hose connection to said weigth preferably by means of transverse passageways through the weight.

Between said weight and the disconnectable part of the coupling separate hoses may extend. A flexible light-weight disconnectable part is obtained in this way which ensures that the hoses, which extend away from said weight towards the spaced apart locations, cannot come into conflict with the floating device.

DETAILED DESCRIPTION OF THE INVENTION

FIG. 1 shows the system of the invention in the ideal central position.

FIG. 2 corresponds to FIG. 1 and shows the system in case the vessel is displaced.

Figure 1:
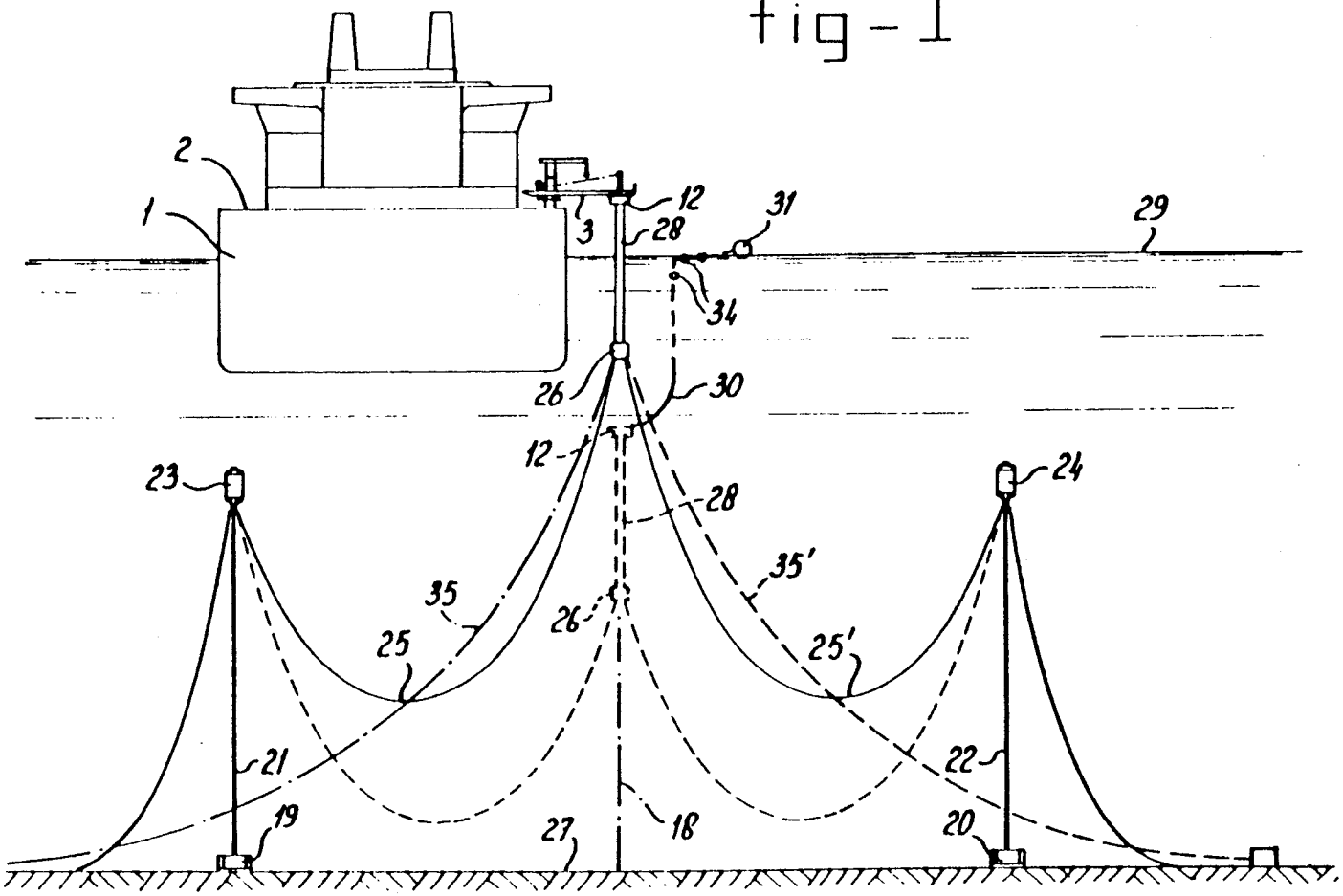
FIGS. 1 and 2 show a tanker 1 which can be held in place by dynamic positioning means, not shown.

Said tanker has on deck 2 near one side an arm 3 which is pivotably mounted about a vertical axis 4 (FIG. 3) on a pedestal 5 by means of a bearing 6. Said arm 3 can be swung from the inboard position shown in FIG. 4 towards the outboard position shown in FIGS. 3 and 5 and locked in place by means of a pin 7.

The swinging movement of the arm 3 inboard and outboard is performed by means of a hydraulic motor 8 and a chain drive 9.

At the outer end of the arm a turntable 10 is provided supported in said arm by means of bearings 11.

Bearing 6 as well as bearing 11 preferably are axial-radial bearings.

Said turntable 10 forms part of the disconnectable coupling formed by the turntable 10 and the disconnectable part 12. The means for connecting and disconnecting are not shown, but are known in the art.

Figure 4:
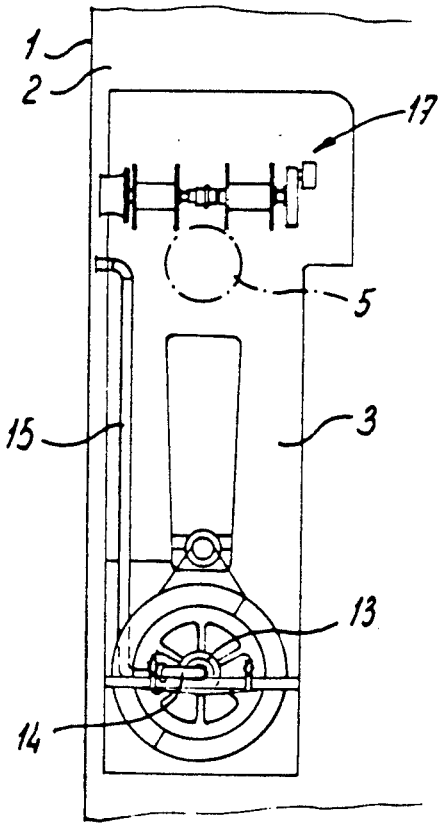
FIG. 4 is a top view of the arm in the inboard swung position.

At the top of the turntable a swivel 13 has been provided from which pipes 14,15 extend towards the vessel (FIG. 4).

Figure 3:
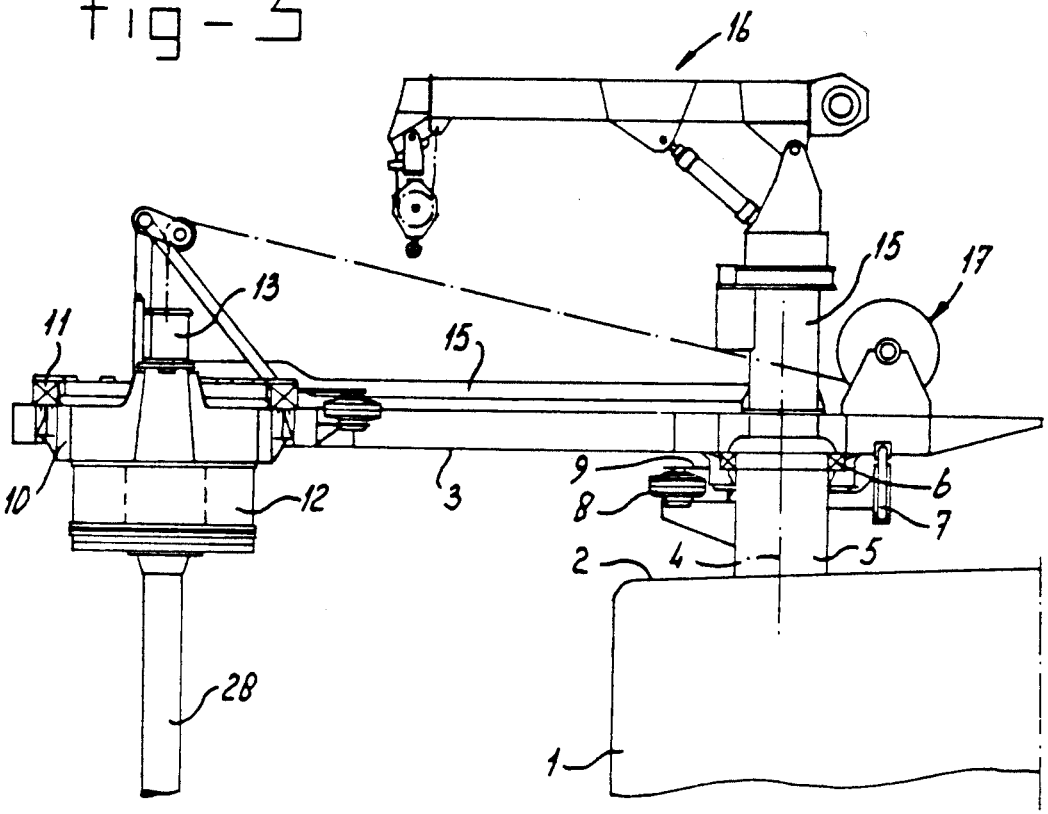
FIG. 3 is a detailed view from one side of the arm.
Figure 5:
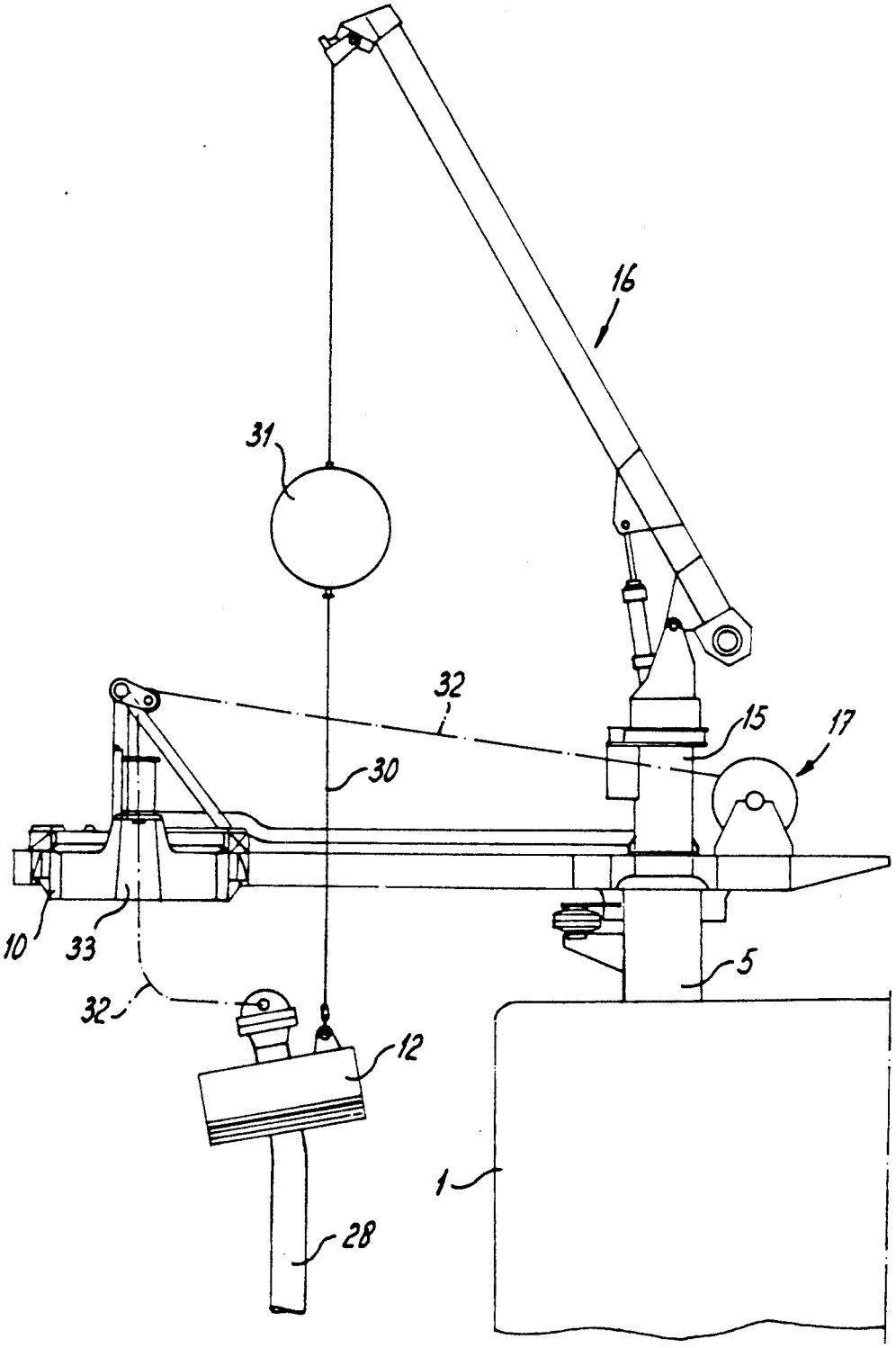
FIG. 5 shows in a view similar to FIG. 3 the reconnection procedure.

Above the pedestal 5 the arm has been provided with a column 15 carrying a crane 16 (FIGS. 3 and 5).

The arm further carries winch means 17.

FIG. 1 shows the ideal position of the vessel with the quick-action coupling 10,12 in line with the vertical center line 18 located between anchors such as 19 and 20 which by means of anchor lines 21,22 are in connection with buoyancy devices 23,24 located on opposite sides of said center line. Said buoyancy devices keep the anchor lines 21,22 under tension and carry hoses 25,25' according to a first catenary line between a weight 26 suspended from the coupling 12 and according to a second catenary line towards not shown locations on the bottom 27 of the body of water.

Instead of the hoses 25,25' it is possible as well to use a single hose extending according to a single catenary line indicated in FIG. 1 by a dotted line 35, combined with a chain extending in opposite direction according to a catenary line indicated by an interrupted line 35' in FIG. 1.

It of course could be possible to give the hose and the chains respectively a double catenary line configuration as well by means of the above described floats 23 and 24.

The weight 26 is suspended from the disconnectable coupling part 12 by means of a cable or otherwise. Between said weight 26 and the coupling part hoses 28 extend.

In the disconnected position, shown with interrupted lines in FIG. 1, the disconnected coupling part 12 with hoses 28 and weight 26 will be below the surface 29 of the body of water, preferably far below it and below the bottom of the vessel 1, and due to the weight of the hoses 25,25' and the positioning of the buoyancy devices 23,24 will be centered with respect to the anchors 19 and 20.

In the connected position a considerable displacement of the tanker 1 is possible without the hoses being harmed.

Figure 2:
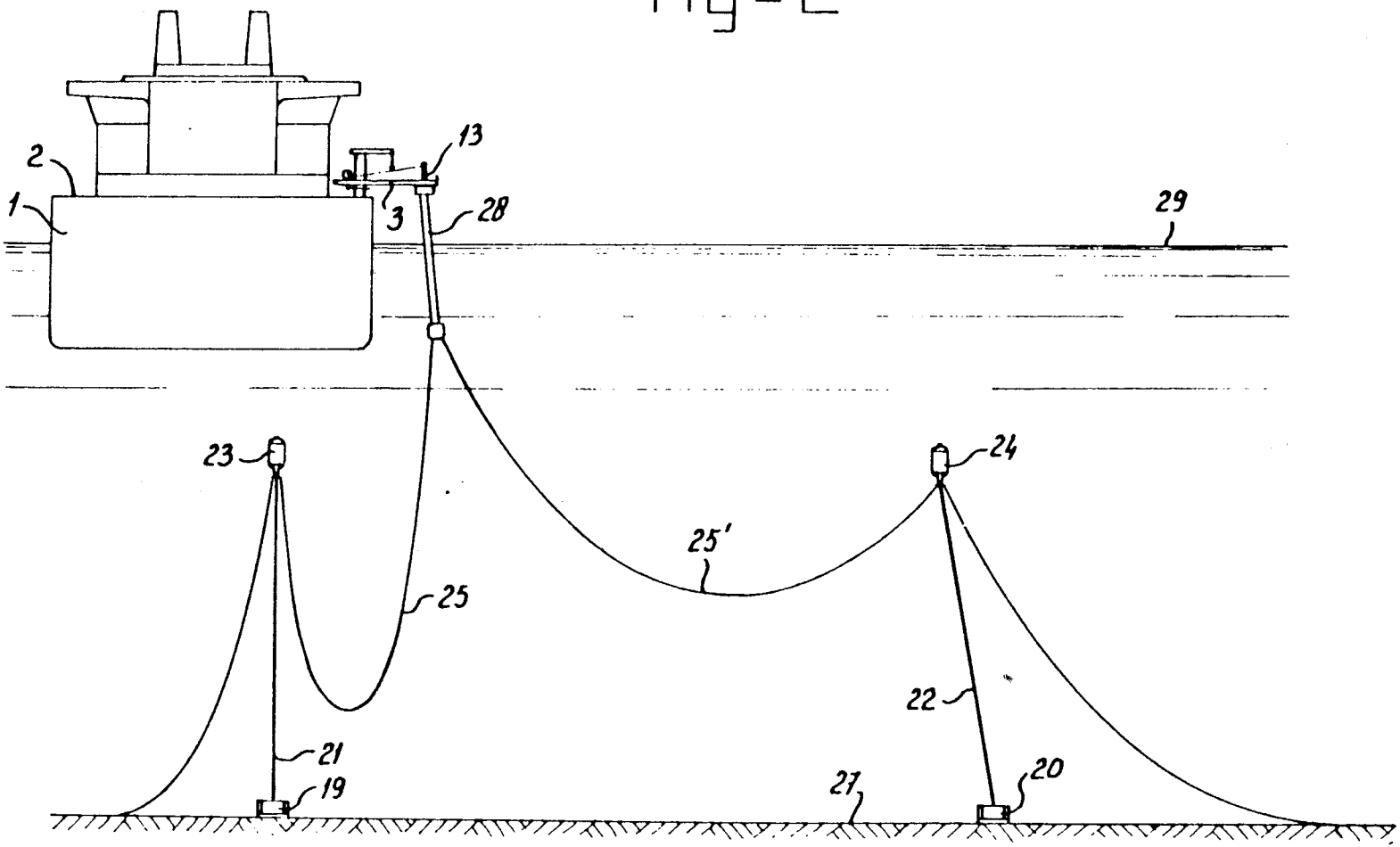

It will be clear from comparing FIGS. 1 and 2 that if in the position shown in FIG. 2 disconnection occurs the disconnected part with hoses 25,25' will automatically move into the position shown with interrupted lines in FIG. 1.

The disconnectable part 12 of the quick-action coupling has been provided with a pick-up line 30 and a float 31. Reconnection can take place as shown in FIG. 5 by picking up the float 31, lifting the buoyant part 12 of the coupling above water level, connecting to it a cable 32 and drawing the coupling part 12 by means of winch 19 and cable 32 into the opening 33 of the turntable 10.

As compared to the prior art construction the assembly of coupling part 12, hoses 28 and weight 26 is of a weight which is and can be relatively light and accordingly it is of great influence whether the contents of the hoses 25,25' are heavy or light.

To take care that in case heavy contents predominate and the submersible parts do not move too deep, additional floats 34 are provided which increase the buoyancy of the disconnected part of the coupling.

We claim:

1. In an offshore loading system comprising an elongated vessel with a bow and a stern and with an outward extending arm carrying a swivel and fluid connections from the swivel towards the vessel, the arm extending out over the water from one side of the vessel between the bow and the stern, a turntable rotatably supported by the outer end of the said arm, a quick action coupling situated at the turntable, a disconnectable-reconnectable part of said coupling having buoyancy, a hose extending downwards from the disconnectable part of the coupling towards a location at or near the water bottom, according to a catenary configuration, the improvement wherein at least two flexible elements, comprising at least one hose extend away from each other from locations on opposite sides of a center line through the coupling in the non-displaced position of the vessel, said two elements each extending in a double catenary configuration obtained by means of a buoyancy device attached to each element, each said buoyancy device being connected to an anchor on the water bottom by separate substantially vertical connection means, the vessel being dynamically positioned when said coupling is engaged and the turntable at the end of the arm having a drive system adapted to rotate the turntable about a vertical axis.

2. Offshore loading system as claimed in claim 1, in which at least two of the flexible elements are hoses.

3. Offshore loading system as claimed in claim 1, in which one flexible element is a hose and the other or others is or are chains.

4. Offshore loading system as claimed in claim 1 in which the arm is rotatable about a vertical axis, and means to swing the arm to inboard and outboard positions as well as means to lock the arm in either one of said positions.

5. Offshore loading system as claimed in claim 1 in which the disconnectable part of the coupling has a pick-up line and a float, the pick-up line having a series of additional floats.

* * * * *